US006851565B2

(12) United States Patent
Stephan

(10) Patent No.: US 6,851,565 B2
(45) Date of Patent: Feb. 8, 2005

(54) NIPPLE ADAPTER FOR A STANDARD NARROW-MOUTHED BEVERAGE BOTTLE

(76) Inventor: Gerard Stephan, 162 Miller Pl., Miller Place, NY (US) 11764

( * ) Notice: Subject to any disclaimer, the term of this patent is extended or adjusted under 35 U.S.C. 154(b) by 0 days.

(21) Appl. No.: 09/927,692

(22) Filed: Aug. 10, 2001

(65) Prior Publication Data

US 2003/0029829 A1 Feb. 13, 2003

(51) Int. Cl.[7] ..... B65D 23/12
(52) U.S. Cl. ..... 215/389; 215/11.1
(58) Field of Search ..... 215/387, 11.1, 215/329

(56) References Cited

U.S. PATENT DOCUMENTS

| | | | | |
|---|---|---|---|---|
| 2,816,548 A | | 12/1957 | Tupper | |
| 2,869,747 A | * | 1/1959 | Patterson | 215/329 X |
| 4,850,496 A | | 7/1989 | Rudell | |
| 5,024,341 A | * | 6/1991 | Dekerle | 215/11.1 |
| 5,105,956 A | * | 4/1992 | Tarn-Lin | 215/11.1 |
| 5,150,800 A | | 9/1992 | Sarter | |
| 5,472,025 A | * | 12/1995 | Conrad et al. | 141/332 |
| 5,551,583 A | * | 9/1996 | Sachathamakul et al. | 215/11.1 X |
| D414,873 S | * | 10/1999 | Kwiecinski | D24/197 |
| 5,988,923 A | * | 11/1999 | Arai | 215/329 X |
| 6,089,389 A | * | 7/2000 | Sharon et al. | 215/11.1 |
| 6,112,926 A | | 9/2000 | Fishman | |
| 6,415,937 B1 | * | 7/2002 | DeJong et al. | 215/11.1 X |

* cited by examiner

*Primary Examiner*—Tri M. Mai
(74) *Attorney, Agent, or Firm*—Alfred M Walker

(57) ABSTRACT

An annular adapter adapts a standard beverage bottle, such as a plastic water bottle, to accommodate the internal threads of a baby's annular nipple cap, which has a nipple inserted therein. Inside the annular adapter is a seal, such as a disc-shaped annular ledge extending in a plane perpendicular to the axis of the adapter, to prevent leakage, when a baby bottle nipple and cap are inserted over the exterior threads of the annular adapter. Liquid flows through the central opening of the annular adapter. The nipple is inserted and the seal engages the bottle of the water bottle, the annular adapter is screwed over a conventional threaded exterior neck of a standard beverage bottle, such as a water bottle.

3 Claims, 1 Drawing Sheet

FIG. 1
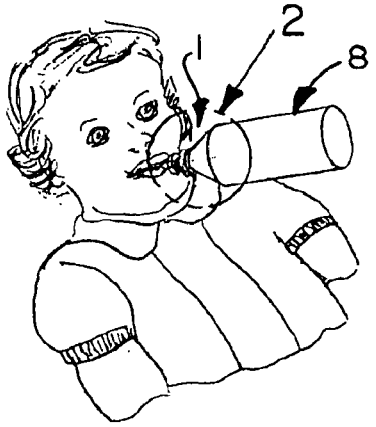
FIG. 2
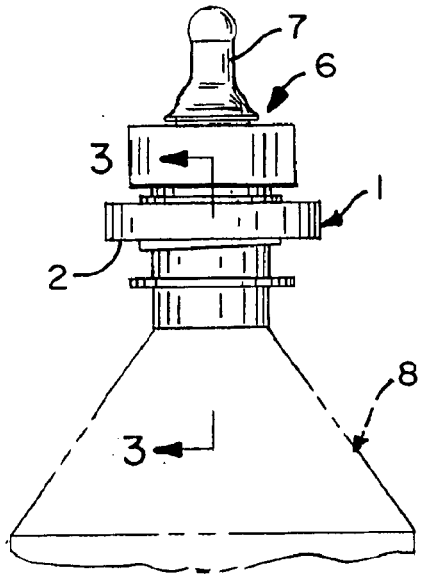
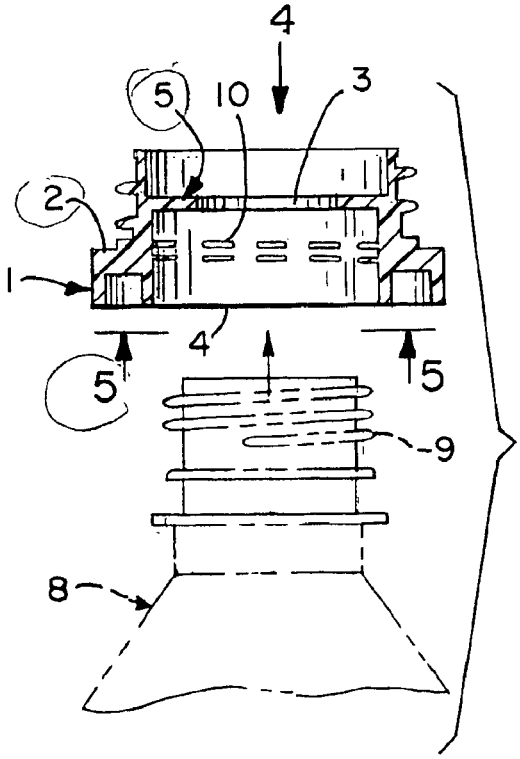
FIG. 3
FIG. 4
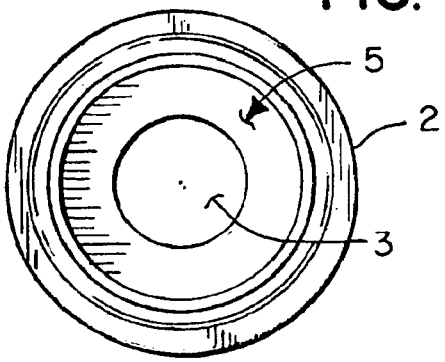
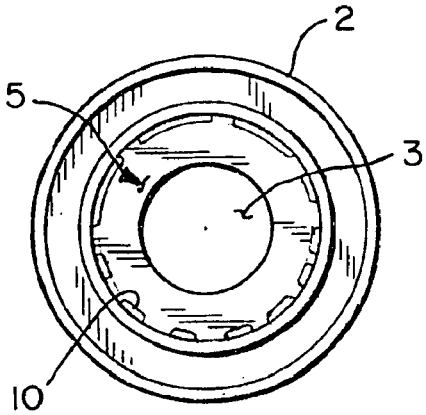
FIG. 5

NIPPLE ADAPTER FOR A STANDARD NARROW-MOUTHED BEVERAGE BOTTLE

This application is based upon my Disclosure Document Number 490144 dated Mar. 15, 2001.

FIELD OF THE INVENTION

The present invention relates to infant beverage dispensers.

BACKGROUND OF THE INVENTION

Often in travel, parents with infants have difficulty filling conventional baby bottles with nipples with drinking fluids, such as water or juice. Furthermore, while juice beverages and water bottles are easily available, they are not adaptable to be used with an infant's nipple.

With respect to related prior art, U.S. Pat. No. 6,112,926 of Fishman describes a pyramid shaped drink-through spout cap for beverages. Fishman '926 mentions briefly in its description of background art a purported adapter for a common beverage bottle, which includes a nipple at a top end thereof, but provides no details thereof. For example, Fishman '926 mentions that a threaded cap device can convert a common water bottle into a nipple bottle, but gives no examples of patents or other publications, such as catalog advertisements, to substantiate that brief statement. In contrast to the present invention, Fishman '926 describes an adapter for what is commonly known as a "Sippy cup" spout for a child being weaned from a nipple drinking bottle and being trained to drink from an open cup or glass. The Sippy Cup spout of Fishman '926 covers the beverage container and extends up for the child to drink therefrom.

Another device is U.S. Pat. No. 2,816,548 of Tupper, which describes a flattened triangular Sippy-cup top.

U.S. Pat. No. 4,850,496 of Rudell describes an adapter 8 for a nipple cap, as shown in FIG. 2 of Rudell's drawings. Rudell's cap has a shoulder portion 9, outer threads 24 to screw into the inner threads 32 to a conventional nipple cap, and inner threads 20 to screw onto outer threads of a bottle, but not a conventional narrow-mouthed beverage bottle.

While Rudell '496 describes a cap for a nipple, but it lacks an annular seal.

Moreover, U.S. Pat. No. 5,150,800 of Sarter describes a training cup for nursing bottles that has a cap with upper lid accommodating a conventional nipple flange and nipple. But the flange cannot be used with a conventional beverage bottle with a twist-off cap.

OBJECTS OF THE INVENTION

It is therefore an object of the present invention to provide an adapter that can utilize a nipple with a conventional narrow-mouthed beverage bottle, in place of the bottle's twist-off cap.

SUMMARY OF THE INVENTION

The present invention includes an annular adapter, typically plastic, such as polypropylene or other suitable material, which is threaded inside, to adapt to the standard outer cap threads of a narrow-mouthed standard beverage bottle, such as a plastic water bottle marked under various brand names such as POLAND SPRINGS®, EVIAN® OR FRUIT-2-0®.

The adapter of the present invention is threaded outside, to accommodate the internal threads of a baby's annular nipple cap and nipple inserted therein.

Inside the annular adapter is also a seal, such as an annular ledge extending in a plane perpendicular to the axis of the adapter, to prevent leakage, when a baby bottle nipple and cap are inserted over the exterior threads of the annular adapter. Liquid flows through the central opening of the annular adapter. Because the sealing flange is slightly resilient, when the adapter is screwed onto the top of the beverage bottle, it functions as a seal.

After the nipple is inserted and the seal engages the bottle of the water bottle, the annular adapter is screwed over a conventional threaded exterior neck of the narrow-mouthed standard beverage bottle, such as a commercially available water bottle.

DESCRIPTION OF THE DRAWINGS

The present invention can best be understood in conjunction with the accompanying drawings, in which:

FIG. 1 is a diagrammatic perspective view of the present invention in application;

FIG. 2 is an enlarged partial view taken within the dotted circle "2" in FIG. 1;

FIG. 3 is an enlarged exploded sectional view taken on line "3—3" of FIG. 2;

FIG. 4 is a top plan view taken in direction of arrow "4" of FIG. 3; and, FIG. 5 is a bottom plan view take in direction of line "5—5" of FIG. 3.

DETAILED DESCRIPTION OF THE INVENTION

As shown in FIGS. 1–5, the present invention includes an annular adapter (1), which includes a collar (2) having a centrally located hole (3) and a threaded interior (4). A sealing flange (5) prevents leakage when a liquid flows through opening hole (3). A nipple cap (6) with a nipple (7) is threaded over the threaded exterior of annular adapter (1), which is screwed over the neck of a conventional beverage bottle (8), such as a plastic water bottle.

Therefore a parent can quickly adapt a standard beverage bottle for use by drinking by an infant or toddler.

Annular adapter (1) adapts a conventional baby bottle nipple and collar to fit a conventional narrow-mouthed threaded beverage bottle top. Adapter (1) includes a cylindrical ring (2) having an internal void (3) therein for fluid flow therethrough.

Female threads are provided on an inner wall (4) of ring (2) for mating with the outer male bottle-top threads of a conventional narrow-diameter threaded-cap beverage container (8). These female threads on inner wall (4) of cylindrical ring (2) permit alternate user mounting and user removal of cylindrical ring (2) respectively onto and from conventional beverage bottle (8).

Cylindrical ring (2) includes external male threads on an outer wall of said ring (2) for alternate user mounting and removal respectively onto and from internal female threads on a conventional baby-bottle nipple collar (6) having a nipple (7) extending therethrough.

Cylindrical ring (2) also includes a circumferential sealing flange (5) extending radially inward from an inner wall of cylindrical ring (2). Flange (5) has a central aperture (3) for permitting fluid flow to the conventional baby-bottle nipple (7) therethrough. Furthermore, flange (5) sits on top of and sealably contacts the top of the conventional narrow mouth of a conventional beverage bottle (8), when cylindrical ring (2) and conventional baby-bottle collar (6) are in their respective mounted positions. Because the sealing flange (5) is slightly resilient, when the adapter (1) is screwed onto the top of the beverage bottle (8), it functions as a seal.

Cylindrical ring (2) further includes a pair of interconnecting chambers therewithin, including a top chamber having an open top end and a bottom chamber having an open bottom end. The top and bottom chambers are internally interconnected by circumferential sealing flange (5), which flange (5) includes an open medial connecting member contiguous respectively with the top and bottom chambers. The open top end of the top chamber has a diameter larger than the diameter of the open bottom end of the bottom chamber.

The bottom chamber includes inner wall (4) with female threads (10) of inner wall (4) receiving and grasping the male threads (9) of a standard beverage bottle top (8).

The top chamber of sealing ring (2) includes the outer wall of cylindrical ring (2), wherein the external male threads are disposed on the top chamber outer wall for grasping the female threads of a conventional baby-bottle nipple sealing ring, so that the user can conveniently install and remove baby drinking nipples (7).

Preferably, circumferential sealing flange (5) is disc-shaped, wherein the diameter of disc-shaped flange (5) is disposed perpendicular to a longitudinal axis of cylindrical ring (2), and wherein the longitudinal axis of cylindrical ring (2) is co-linear with a longitudinal axis of conventional beverage container (8).

It is further known that other modifications may be made to the present invention, without departing from the scope of the invention, as noted in the appended Claims.

I claim:

1. An integral single piece adapter ring with internal female and external male threads, for adapting a conventional baby bottle nipple-and-collar to fit a conventional narrow-mouthed threaded beverage bottle top, said adapter comprising:

a cylindrical ring (2) having an internal void (3) therein;

said female threads located on an inner wall (4) of said ring (2);

said female threads for mating with respective male bottle-top threads of a conventional narrow-diameter threaded-cap beverage container (8), said female threads on said inner wall (4) for permitting alternate user mounting and user removal of said cylindrical ring (2) respectively onto and from said conventional beverage bottle (8);

said cylindrical ring (2) having external male threads on an outer wall of said ring (2); said male threads for alternate user mounting and removal respectively onto and from respective internal female threads on a conventional baby-bottle nipple collar (6);

an unbraced, unencumbered resilient circumferential sealing flange (5), said sealing flange being completely flat on its respective top and bottom surfaces, said sealing flange extending radially inward from said inner wall of said ring (2);

said completely flat sealing flange (5) having a central aperture for permitting fluid flow to a conventional baby-bottle nipple (7) therethrough; said completely flat sealing flange (5) sealably contacting an upper edge of the conventional beverage bottle spout when said cylindrical ring (2) and said conventional baby-bottle collar are in their respective mounted positions; and an uninterrupted top chamber above said sealing flange (5) and a bottom chamber below said sealing flange (5), said top chamber having a smooth, cylindrical interior wall and a diameter larger than the diameter of said bottom chamber.

2. An integral, single piece adapter for adapting a baby bottle nipple for use on and with a narrow-mouthed threaded beverage bottle top comprising:

a circular ring divided in the interior thereof into an uninterrupted top chamber and a bottom chamber by an inwardly extending unbraced, unencumbered resilient sealing flange, said unbraced, unencumbered sealing flange being completely flat on respective top and bottom surfaces thereof for engaging and sealing a top opening of said beverage bottle top, said completely flat sealing flange having an opening for passage of liquid;

said top chamber having an uninterrupted recess therein and a smooth cylindrical interior wall surface;

female threads being provided along an inner surface of said bottom chamber for engaging threads on the outside of said beverage bottle top;

a collar formed on the outside of said ring adjacent a lower opening into said bottom chamber; and male threads on the outside of said ring above said collar for engagement with a collar accommodating said nipple therein.

3. The integral, single piece adapter of claim 2 in which said top chamber has a larger inside diameter than said bottom chamber.

* * * * *